US011479947B2

(12) United States Patent
Triginer et al.

(10) Patent No.: US 11,479,947 B2
(45) Date of Patent: Oct. 25, 2022

(54) FASTENING DEVICE FOR WEAR PARTS IN EARTH-MOVING MACHINES AND SYSTEM

(71) Applicant: METALOGENIA RESEARCH & TECHNOLOGIES S.L., Barcelona (ES)

(72) Inventors: Javier Triginer, Barcelona (ES); Nil Vallvé, Cabrera de Mar (ES); Justo Jesús Ortiz García, Barcelona (ES); Jordi Marquez Llinas, Terrassa (ES); Albert Gimeno Tordera, Barcelona (ES); Jorge Triginer Boixeda, Barcelona (ES); Ester Alonso Frigola, Celra (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 78 days.

(21) Appl. No.: 16/969,041

(22) PCT Filed: Feb. 12, 2019

(86) PCT No.: PCT/EP2019/053469
§ 371 (c)(1),
(2) Date: Aug. 11, 2020

(87) PCT Pub. No.: WO2019/155095
PCT Pub. Date: Aug. 15, 2019

(65) Prior Publication Data

US 2021/0032845 A1 Feb. 4, 2021

(30) Foreign Application Priority Data

Feb. 12, 2018 (EP) ..... 18382076

(51) Int. Cl.
*E02F 9/28* (2006.01)
*E02F 9/20* (2006.01)

(52) U.S. Cl.
CPC ..... *E02F 9/2025* (2013.01); *E02F 9/2833* (2013.01)

(58) Field of Classification Search
CPC ..... E02F 9/2025; E02F 9/2833
See application file for complete search history.

(56) References Cited

U.S. PATENT DOCUMENTS 5,926,982 A * 7/1999 Keech ..... E02F 9/2866 37/455
5,966,850 A 10/1999 Horton
(Continued)

FOREIGN PATENT DOCUMENTS

WO 2017/144305 * 8/2017
WO 2017/144305 A1 8/2017

OTHER PUBLICATIONS

International search report for PCT/EP2019/053469 dated Apr. 16, 2019.
Written Opinion for PCT/EP2019/053469 dated Apr. 16, 2019.

*Primary Examiner* — Gary S Hartmann
(74) *Attorney, Agent, or Firm* — Sughrue Mion, PLLC

(57) ABSTRACT

A fastening device for wear elements in earth-moving machines, related to a fastening device of the type that is arranged between two parts, components or elements of an earth-moving machine for the fastening or coupling between both parts or elements. The device has at least one mobile blocking element and autonomous activation mechanism of the mobile blocking element, which enables the mobile blocking element to be activated such that, once the fastening device is inserted in a housing for this purpose in any of the parts to be coupled, the effective coupling is achieved at
(Continued)

a certain distance from the fastening device, and even from the machine.

20 Claims, 9 Drawing Sheets

(56) References Cited

U.S. PATENT DOCUMENTS

| | | | | |
|---|---|---|---|---|
| 8,387,290 | B2 * | 3/2013 | Campomanes | E02F 9/2825 37/456 |
| 9,714,923 | B2 * | 7/2017 | Behmlander | G01N 29/262 |
| 9,850,641 | B2 * | 12/2017 | Hughes | E02F 9/2825 |
| 10,774,500 | B2 * | 9/2020 | Harder | E02F 3/407 |
| 2016/0326723 | A1 | 11/2016 | Behmlander et al. | |

* cited by examiner

FASTENING DEVICE FOR WEAR PARTS IN EARTH-MOVING MACHINES AND SYSTEM

CROSS-REFERENCE TO RELATED APPLICATIONS

This application is a National Stage of International Application No. PCT/EP2019/053469 filed on Feb. 12, 2019, which claims priority under U.S.C. § 119(a) to European Patent Application No. EP18382076.0 filed on Feb. 12, 2018.

DESCRIPTION OF THE INVENTION

The present invention, a fastening device for wear elements in earth-moving machines, relates to a fastening device of the type arranged between two parts, components or elements of an earth-moving machine for the fastening or coupling between either parts or elements. Said device has at least one mobile blocking element and autonomous activation means of the mobile blocking element, which enable said mobile blocking element to be activated such that, once the fastening device is inserted in a housing for this purpose in any of the parts to be coupled, an effective coupling is achieved.

Said fastening device is arranged such that when the mobile blocking element is activated, it can engage between two wear parts, usually a tooth and an adaptor, tooth-holder or intermediate part, which are in turn coupled to the bucket of an earth-moving machine.

The mobile blocking element can be periodically activated in order to maintain the tightness and/or position between the components of the system and can likewise be reactivated in order to stop carrying out the function thereof and enable both parts to be uncoupled or separated from each other. This activation can be autonomous, such that the fastening device is tightened on its own, or remotely controlled by a user. The invention also relates to a fastening system between a first wear part, usually a tooth or wear element, and a second part, usually a tooth-holder or adapter, in earth-moving machines.

The field of application of the present invention is the sector of machines for moving earth and rocks, mining, dredging, etc.

DESCRIPTION OF THE STATE OF THE ART

A number of fastening or retention devices are known in the state of the art, which are mainly known as pins that serve to couple two parts, elements or components together, usually wear elements to the adapters thereof, for example a tooth and a tooth-holder, a protector and a blade of a bucket, etc., which are used to move earth, rocks and the like.

These machines have several wear elements as work elements, which are coupled to adapters that are in turn coupled to the blade of a bucket, the latter being joined to the arm of the machine for moving earth. The wear elements are elements that wear down faster than the rest of the components since they are in direct and continuous contact with the work surface, whether this is sand, rocks, earth, etc. The wear elements are detachably fastened to the adapters or the blade by means of devices that enable the replacement of the wear element on the adapter once the first has worn down and the adapter has not yet done so.

These fastening devices must be placed when a new wear element is to be coupled to an adapter and must be removed when the wear element has worn down and a new wear element is to be placed on the same adapter. In summary, the fastening devices must be removable in order to make the replacement of the wear element possible.

There are a number of fastening systems with different retention mechanisms, for example, devices that are placed and removed with a hammer, under pressure, devices that have elastic elements in order to facilitate the disassembly thereof, devices that must be destroyed in order to remove them, etc. Almost all of them share the following essential steps: the insertion of the fastening device in a housing, usually created between the wear element and the adapter; the coupling of the wear element in the adapter, and the manual actuation by an operator using a tool and/or hammer directly on the fastening device in order to achieve the fastening between the wear element and the adapter to each other. In order to remove the fastening device it is usually necessary to act directly on the fastening device, either by means of hammers or another tool, and subsequently removing the fastening device.

Despite the existing different options, all the fastening devices have a common characteristic which is that one, or several, users must use different tools to handle them directly, that is, acting directly thereon and making it possible to couple and uncouple the two parts of the machine, usually a wear part or tooth and the adapter or blade. The tools used occasionally require the fastening device to include a housing in order to be able to couple the tool to the device and thus act thereon, which reduces the robustness of the fastening device itself, making it weaker and susceptible to breaking.

The above has the risk that accidents may happen, which affect the physical integrity of the operators, derived from the in situ handling of the components, and mainly on those occasions when the elements are heavy and large in size.

Therefore, and according to the above, the fastening systems of the state of the art can be divided into two main types, depending on whether or not they require a hammer (or blows) in order to insert and remove a pin, that is, non-hammerless systems (which require a hammer) and hammerless systems (which do not require one). The first lack safety due to the insertion and removal conditions of the pin, and the second are not robust since they require recesses or housings in the pins in order to insert the tool. The present invention resolves these two problems by achieving a fastening system that is both robust and safe for the operator.

Furthermore, another disadvantage of the retention systems known in the state of the art is that the same lose retention properties as they are used due to the working conditions. When the machine is working, the gap between the wear part or tooth and the second part, adapter or tooth-holder, increases due to the working conditions that entail constant blows that subject the parts to significant stresses. This work creates deformations in the components that cause them to lose the tightness between them at the time they are coupled or mounted (in design conditions or in new conditions) due to the increase of the gap between the parts and the pin, along with the disadvantage that this entails as the misalignment between the parts increases. The present invention resolves this problem given that the fastening device enables the autonomous or automatic periodic activation thereof without receiving an external signal, for example through a timer or managed by a processor, in order to maintain the tightness in the system.

As such, one of the objectives of the present invention is a fastening, retention or coupling device that enables the installation and uninstallation thereof and that is autonomously, automatically activated or remotely activated by an operator, such that after the fastening device has been inserted between the parts to be coupled, the operator does not have to directly handle said device in order for both parts to be fastened to each other, but rather the device can do it autonomously, by itself, or controlled by a computer program (software) and a processor or remotely by a user. Likewise, the device enables the growing gap between the parts to be adapted as the working time thereof increases, reducing said gap and maintaining an adjusted position between both, that is, maintaining the tightness between the components involved. This adjustment, tightening or tensioning increases the reliability of the system, thus preventing possible losses or breakages of teeth.

DESCRIPTION

The first object of the present invention, according to claim 1, is a fastening device, with a mobile blocking element in order to facilitate the coupling and uncoupling of two parts or elements of a machine for moving earth by means of the autonomous activation, without using tools handled by operators that come into contact with the fastening device, of said mobile blocking element arranged in the fastening device. Likewise, the autonomous activation of the mobile blocking element can be programmed so that it autonomously and automatically activates periodically or when there is a specific external input, although it can also be activated remotely by a computer program (software) and/or by an operator, given that the fastening device preferably comprises an integrated processor.

The terms autonomous activation of the mobile blocking element must be understood, in the context of the present invention, as referring to the fact that the activation thereof is done by itself, that is, it does not require the application by an operator of any action or stress that acts directly on the blocking mechanism or element, that is, that due to the action of other elements, which can be controlled remotely or not by an operator, the blocking element is actuated.

That is, in order to ensure that the tightness between the different components of the system is maintained as the wear thereof increases due to the stresses to which they are subjected, the mobile blocking element can be periodically activated, autonomously or controlled remotely by an operator, in order to ensure the tightness between the components of the system, reducing the spaces that are created during work.

Specifically, the invention relates to a fastening device of a wear part or first part in a second part, a tooth-holder or adapter, in earth-moving machines comprising at least one mobile blocking element and autonomous activation means of said mobile blocking element such that when the mobile element is activated it engages between the two parts, blocking the position between both and, when deactivated, the mobile element stops engaging between both parts, thus unblocking the position between both and enabling the uncoupling thereof. Said autonomous activation means can also be controlled remotely.

Specifically, the fastening device may comprise, in addition to said mobile blocking element:

- actuation means of the mobile blocking element connected to the activation means,
- transmission means located between the actuation means and the mobile blocking element, and
- a power supply of the actuation means of the mobile blocking element.

In order to achieve the autonomous activation, as well as the management of the activation means and the power supply, the fastening device comprises the necessary electronic components, among which a microprocessor, or processor, integrated in the device itself is of note. Among said electronic components, it is possible to include:

- a receiver or emitter/receiver device to receive remote signals or send and receive signals,
- sensors that enable the measurement of variables inside the housings, such as for example, the temperature, the stresses to which the device is subjected, distances between the device and the parts between which it is situated,
- timers or other components that enable the mobile blocking element to be activated autonomously, depending on the operation time or depending on other parameters, in order to maintain the tightness between the components, reducing the gap between the same and that is created due to the stresses to which the system is subjected, and
- positioning and location devices of the device, such as a GPS.

Preferably, the actuation means comprise an electric or hydraulic or pneumatic motor and mechanical and/or hydraulic and/or pneumatic and/or magnetic transmission means arranged between the motor and the blocking element, although they can also comprise electromagnetic elements that generate at least one electromagnetic field that acts on the blocking element. In this way, when the mobile blocking element is autonomously or remotely activated, the actuation means act on said mobile blocking element or elements that move and/or rotate with respect to a resting position to a blocking position to prevent the two wear parts, elements or components from separating, thus tightening the system. Depending on the intended conditions of use, in order for the device to operate autonomously or remotely, at some time the actuation means will be reactivated, and these will cause the mobile blocking element or elements return to the resting position thereof enabling the disassembly of both parts.

The activation means of the mobile blocking element comprise, as mentioned above, at least one microprocessor or CPU (Central Processing Unit) responsible for storing the previously programmed instructions and executing them, as well as receiving signals from the exterior and emitting signals to the exterior depending on the conditions of use of the device and system. This processor, preferably integrated in an electronic board, is conveniently placed in the device and duly insulated and protected.

For the autonomous activation of the mobile blocking element, the autonomous activation means may comprise, in addition to the microprocessor, other electronic components as additional information sources such as a timer integrated in the CPU itself that, for every specific period of time, activates the mobile blocking elements that cause the tightness between the components to be maintained. Another option is that the microprocessor receives information from different sensors installed in the fastening device itself or in other components of the system, such that depending on the information received it activates said mobile blocking element in order to maintain the tightness between the components or, on the contrary, so that said tightness is removed completely, the mobile blocking element stops actuating and the replacement of the wear element can take place. In this latter case, the microprocessor can receive information from sensor located in the wear element that detect the state of wear of the same, or information stored in the microprocessor related to the time of use of the wear element, the number of impacts received by the wear element (collected by the corresponding sensor).

For the remote activation of the mobile blocking element, the remote activation means mainly comprise an emitter device, separated from the fastening device as well as from the parts to be coupled together, and independent from the same as well as from the rest of the components of the machine for moving earth, and a receiver device preferably located in the fastening device itself, although it could be located in any other of the components of the system, including the parts to be coupled. Said remote communication between the emitter and the receiver is preferably wireless, although wired communication might sometimes be necessary. Likewise, it may be necessary, depending on the conditions and distance between the fastening device and the emitter device, to have several receivers and emitters between a first emitter device and the receiver device closest to the actuation means that are activated by the receiver device.

Likewise, as has been provided, the communication can be bidirectional between the emitter and receiver devices, such that they may act as emitter-receiver devices. This option is necessary if electronic elements are incorporated in the different components of the system in order to gather information from the same, such as temperatures or deformations of the different components in order to know about the operation thereof by obtaining data that can be analysed or to determine the operation conditions of the different components involved in both the device and the system.

By means of the foregoing, the device can react in a predetermined manner depending on the external or internal input that it receives, such as for example: the detection of a blow received by the device causes the tightening of the components, the detection of an exceptional and unusual position of the device causes the movement of the mobile blocking element and therefore the blocking system; or the receipt of a periodic signal to maintain the system tight, among other possibilities.

Furthermore, the power supply, which is preferably a battery and responsible for activating the actuation means, is preferably located in the fastening device itself, next to the actuation means, although depending on the working and/or design conditions, it is also possible to locate it in any of the parts, components or elements of the earth-moving machine. Likewise, the power supply can be recharged from outside the device, for which there is a connection in any component of the system that is duly connected to the power supply.

The fastening device preferably comprises an elongated configuration with an longitudinal axis with respect to which the aforementioned mobile blocking element moves when it is activated by the actuation means, such that the mobile blocking element moves with respect to said longitudinal axis. For example, the mobile element moves longitudinally with respect to the longitudinal axis of the fastening device, or perpendicularly with respect to said longitudinal axis, or by rotating with respect to said longitudinal axis, or it combines different movements, for example longitudinal and rotary, or angled with respect to the longitudinal axis. Alternatively, the fastening device can have other configurations, such as for example spherical, and where the mobile element or elements move with respect to the axes thereof. Further, the fastening device can have two parallel longitudinal axis, a first one with respect to which the blocking element or elements move longitudinally, and a second axis along which the other elements of the fastening device, such as the autonomous means, the battery and/or the activation means, can be arranged. The transmission means will help to transmit the torque from the activation means or motor on the second axis to the blocking element or elements placed on the first axis. It would also be possible to have the components of the fastening device placed along more than two axis, varying the disposition of the components on the same. For example, two blocking elements placed on two different axis, preferably parallel, and the rest of the components along a third axis. Said blocking elements can move in the same or different direction.

The aim is for the mobile blocking element to engage between the wear part and the second part, preventing the separation thereof. For this purpose the mobile blocking element can be inserted in housings in one part or another depending on the location thereof, exerting pressure on one part or another, gripping one part or another or elements of some of them, being possible to have different constructions in order to adapt to the components of the system and, in particular, to the different constructions of the wear parts and second parts. The fastening device must be duly retained in the working position thereof such that the movement of the mobile blocking element, or elements, is made possible but preventing the movement of the rest of the components of the fastening device, and therefore additional securing elements can be used.

In view of the above, the fastening device comprises, within its corresponding case:

- at least one mobile blocking element, although two blocking elements preferably moving in opposite directions along a first axis is also possible, for example comprising a screwed shaft and a bolt, for example,
- autonomous activation means, comprising a microprocessor or processor that can also comprise or be connected to different electronic components, such as an emitter and/or receptor of signals,
- actuation means, such as a motor, for moving the mobile blocking element or elements,
- transmission means, preferably comprising gears (although the previously mentioned alternatives for transmission means can also be used) that are used as elements for reducing the speed and increasing the transmitted torque, or other transmission means, to connect the actuation means to the blocking element or elements, and
- a power supply, such as at least one battery, for providing power to the autonomous activation means and the actuation means.

Said transmission means are specially important when the actuation means or motor do not have the required power to move the blocking element or elements because due to the reduced existing space in the fastening device the actuation means have to be small in size. The transmission means are preferably gears working as speed reducers that serve to increase the torque exiting from the actuation means to a torque capable of moving the blocking element or elements. The number of gears or reducers to be placed between the exit of the actuation means and the blocking element or elements will depend on the space, torque exiting from the actuation element and torque required to move the blocking element or elements. For example, a first reducer can be placed at the exit shaft of the actuation element and a second reducer can between said first reducer and the blocking element or elements to transmit the torque to this/these.

It is important to highlight that the fastening device will usually be working in dirty conditions, subjected to impacts and subjected to wearing, but even under this unfavorable conditions the mobile blocking elements should be able to move requiring a motor torque that counteracts said unfavorable conditions that will prevent the movement of the mobile blocking element. As stated, this motor torque is mainly achieved due to transmission means comprising gear reducers that allow decreasing the speed and increasing the torque at the same time. The fastening device should also preferably have space for the power supply to provide energy to the actuation means or motor.

In the fastening devices comprising two mobile blocking elements, moving along the same first longitudinal axis, the actuation means as well as the battery of the fastening device are placed preferably along a second longitudinal axis parallel to said first axis. The autonomous activation means would preferably be placed between both first and second longitudinal axis, between the blocking element and the actuator means and/or between the blocking element and the battery. Anyway, said autonomous means could be placed anywhere in the fastening device.

A second object of the present invention is a retention system according to claim 12. The retention system is between a first wear part and a second part in earth-moving machines comprising a fastening device such as the one described above. The system enables, depending on the configuration of the fastening device and of the parts to be coupled, different configurations, such as for example, among other constructive alternatives:

- Fastening device arranged in a housing in the second part engaging with a hole arranged in the wear part or exerting pressure on a surface of the wear part through a friction surface of the fastening device,
- Fastening device arranged in a housing formed by a channel in the second part and at least one hole in the wear part, or
- Fastening device arranged in a housing in the second part engaging with a projection arranged in the wear part.
- Likewise, the fastening device can be arranged in a housing in the first part, such that the mobile blocking element engages with a cavity, hole, housing or surface of the second part.

In summary, one of the two parts to be coupled and that make up the system must generally have a housing or cavity to house the fastening device and the opposite part having an interaction element with which the mobile blocking element of the fastening device can interact in order to make it possible for both parts to be fastened or retained to each other. Examples of interaction elements can be, as described above, a contact or friction surface, holes, cavities, housings, projections, protrusions, grooves, or others.

DESCRIPTION OF THE FIGURES

The present invention includes the following figures that show, in a non-limiting manner, several exemplary embodiments of the invention object of the present patent application.

DESCRIPTION OF A PREFERRED EMBODIMENT

The invention shall be described below in accordance with the figures included in the present invention.

Figure 1:
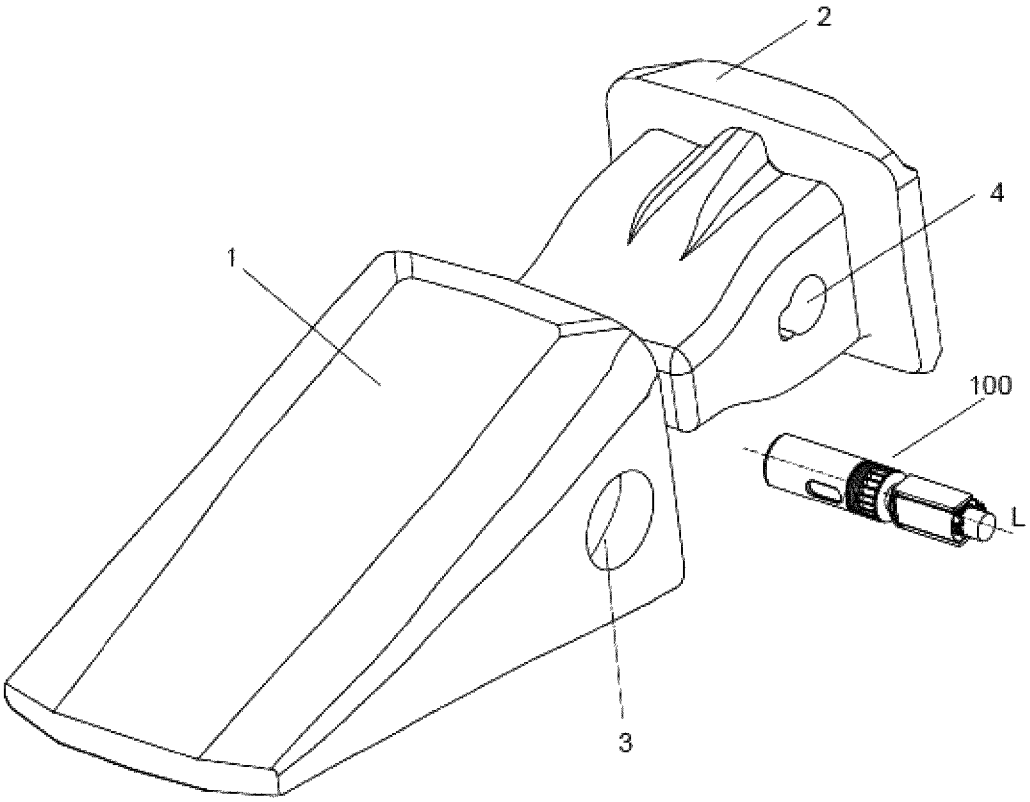
FIG. 1 shows a retention system between two parts, a wear part or tooth and a second part, which can be a tooth-holder or an intermediate element between the tooth-holder and the tooth, and a first embodiment of the fastening device object of the invention in a position before being coupled.
Figure 2:
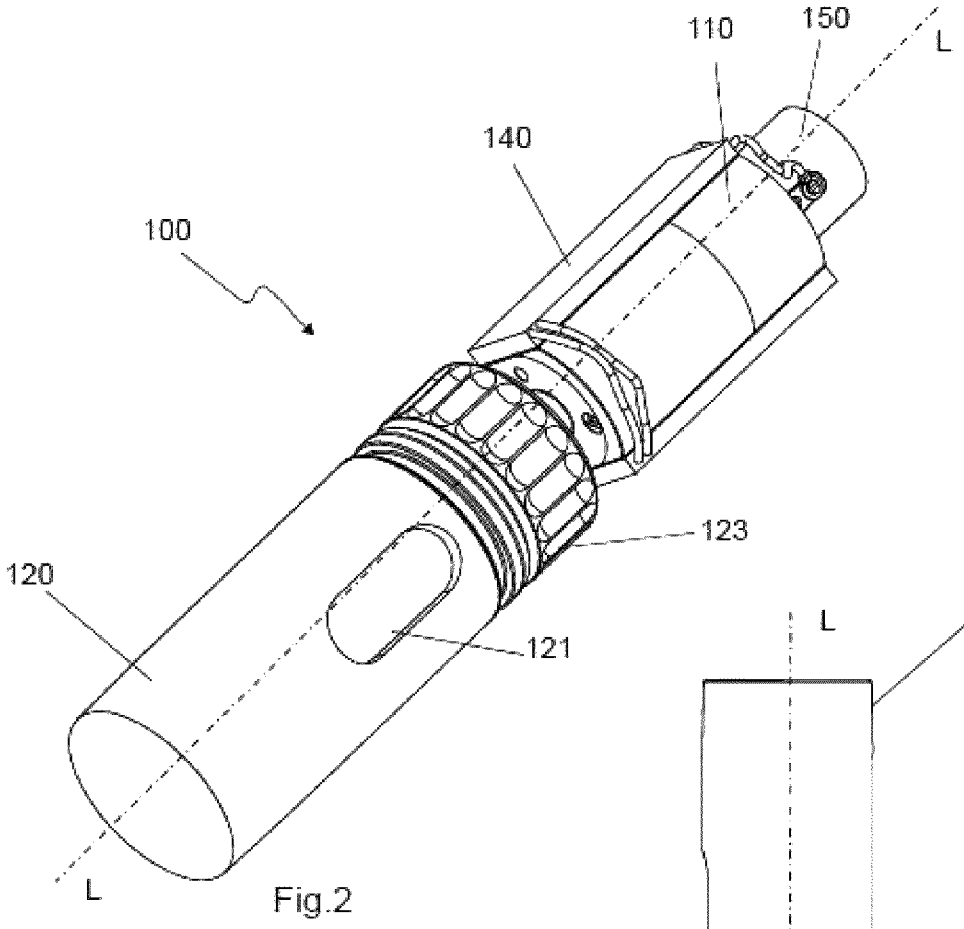
FIG. 2 shows a perspective view of a first embodiment of a fastening device according to the invention.
Figure 3:
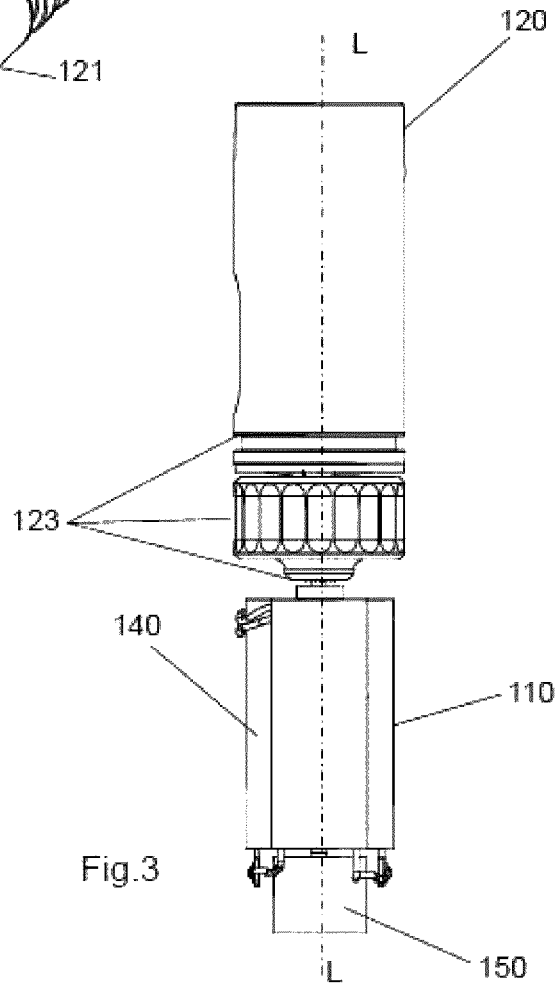
FIG. 3 shows an elevation view of the first embodiment of a fastening device according to the invention.

FIGS. 1 to 3 show a first embodiment wherein a tooth 1 and an adapter 2 that are coupled by means of a fastening device 100 can be seen. Said fastening device 100 is inserted in a channel 4 in the nose of the adapter 2 and subsequently the tooth 1 is coupled on the adapter 2 in the cavity of the tooth 1 that in turn has a hole 3 such that, when the tooth 1 and the adapter 2 are coupled, said hole 3 is aligned with the channel 4 of the tooth-holder 2.

The fastening device 100 comprises a body with a longitudinal axis L and a mobile blocking element 120 that is activated from the activation means 150 and that is located at one end of the fastening device 100, and by means of the longitudinal movement of this mobile element 120 along the axis L, the fastening of the coupling between the tooth 1 and the tooth-holder 2 is achieved when it engages with the two parts. In order to achieve the movement of the mobile element 120, the fastening device 100 comprises at the opposite end thereof a motor 110 as an actuation means of the aforementioned mobile blocking element 120, as well as mechanical transmission means 123 arranged between the motor 110 and the mobile element 120. Said transmission means 123 can also be hydraulic, pneumatic, magnetic or a combination of any of the above. The motor 110 has power supply means 140, preferably batteries connected to the motor 110, which activate the same and that are in turn connected to the activation means 150. These activation means 150 can be a receiver device, which receives instructions from the exterior of the device, sent by an emitter device controlled by an operator, or can be a microprocessor that incorporates the operation instructions of the fastening device so that the retention device and mechanisms operate autonomously. These activation means 150 can receive information from different sensors arranged in the different components, such that even when it is detected that the tooth and the adapter have been coupled, the mobile blocking element is automatically and autonomously activated.

In accordance with the previous arrangement, and once the fastening device 100 is inserted in the channel 4 of the tooth-holder 2 and the nose of the tooth-holder 2 is subsequently coupled in the housing of the tooth 1, a signal (remote or automatic) is generated by means of which the activation means 150 activates the electric or hydraulic or pneumatic motor 110 that is powered by a power supply, a battery 140, and that through the mechanical transmission means 123 longitudinally moves the mobile blocking means 120 along the axis L, by means of an inner shaft 122 (FIG. 4) which functions as a screw (a worm screw could also be used). This mobile element 120 moves with respect to the inner axis and is inserted in the hole 3 of the tooth 1, coming into contact with the walls of said hole 3, ensuring the tooth 1 and tooth-holder 2 are secured or retained and thus preventing the tooth 1 from being separated from the tooth-holder 2. Said transmission means 123 can also be hydraulic, pneumatic or a combination of any of the above. It must be noted that the fastening device must be secured in some way to the tooth-holder 2.

The activation means 150 also enable the fastening device 100 to autonomously maintain the tightness between the tooth 1 and the nose of the adapter 2 during the operation of the system by means of the periodic activation of the mobile blocking element depending on the different constraints that are previously predefined and stored in the processor of the activation means 150 or in a controller that is external to the device and even the machine.

In the previous example, the fastening device 100 only has one mobile blocking element 120 at one end, although in an alternative construction (not shown) a second mobile blocking element 120 could be included at the opposite end, the rest of the components being arranged between both mobile blocking elements 120.

Figure 4:
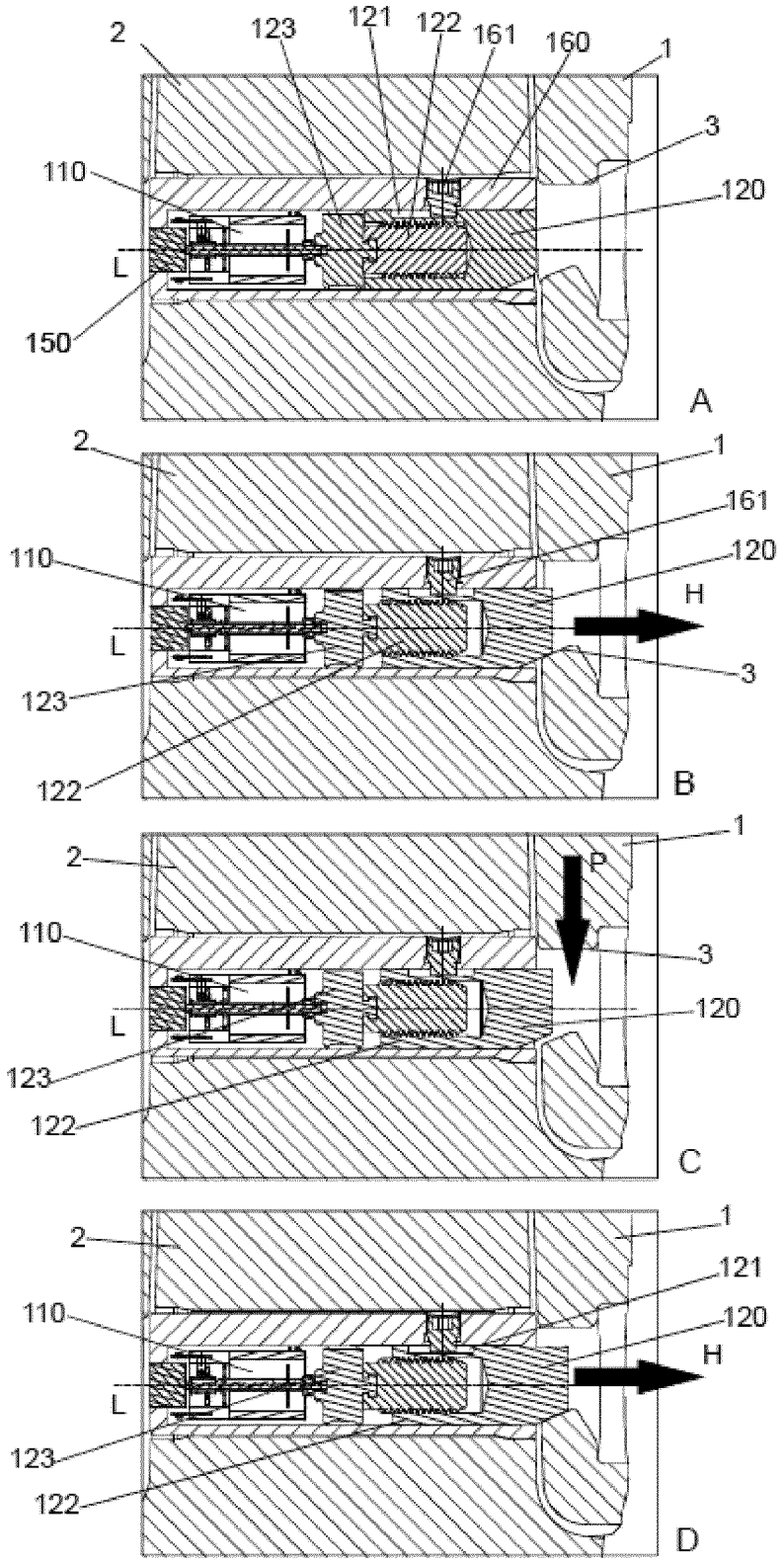
FIG. 4 shows four stages, A to D, of the operation of a fastening device in accordance with the previous figures, in an alternative operation or functioning.
Figure 5:
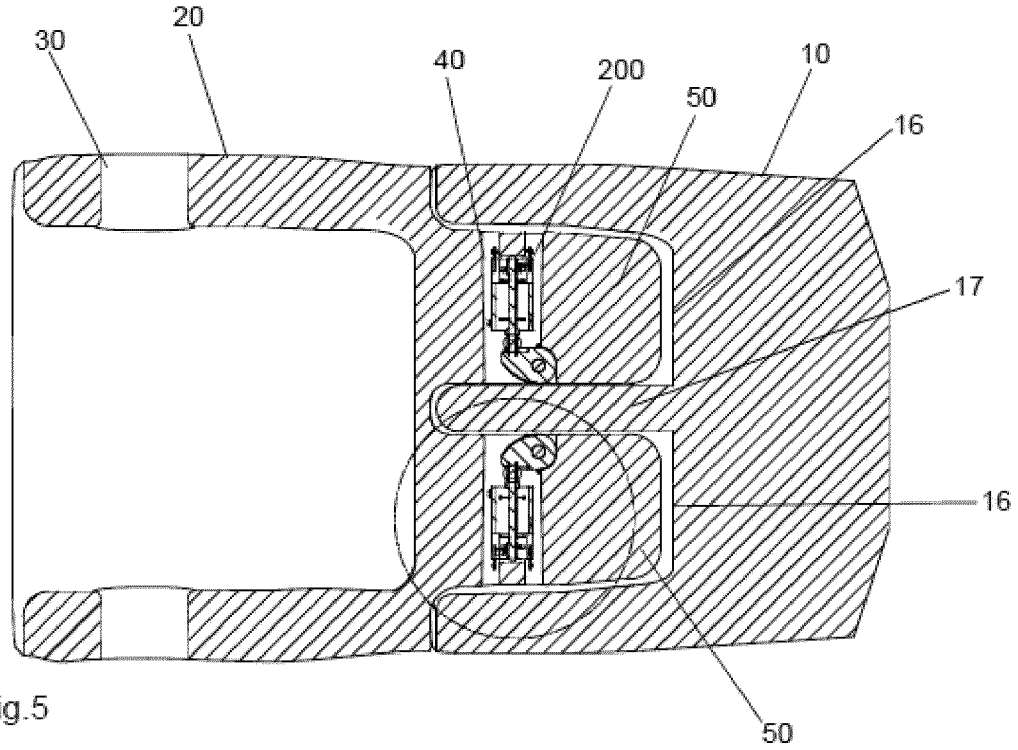
FIG. 5 shows a cross section of a retention system between two parts, a first wear part or tooth and a second wear part, which can be a tooth-holder or an intermediate part or element, where this second part comprises two housings in which two fastening devices are inserted in accordance with a second embodiment object of the invention.
Figure 6:
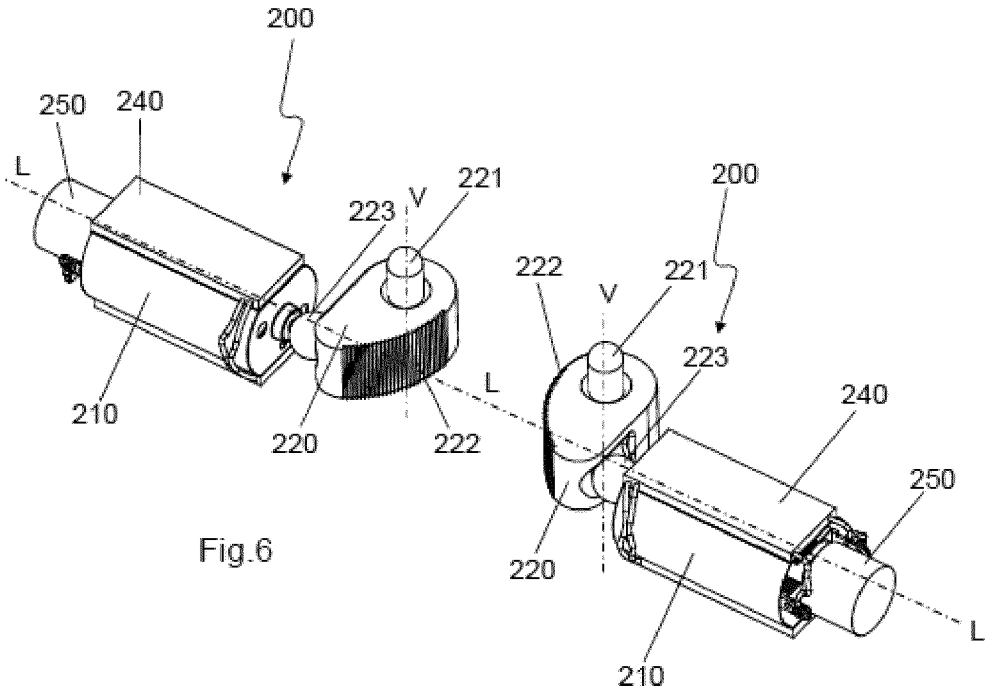
FIG. 6 shows a perspective view of the two fastening devices in accordance with the second embodiment.
Figure 7:
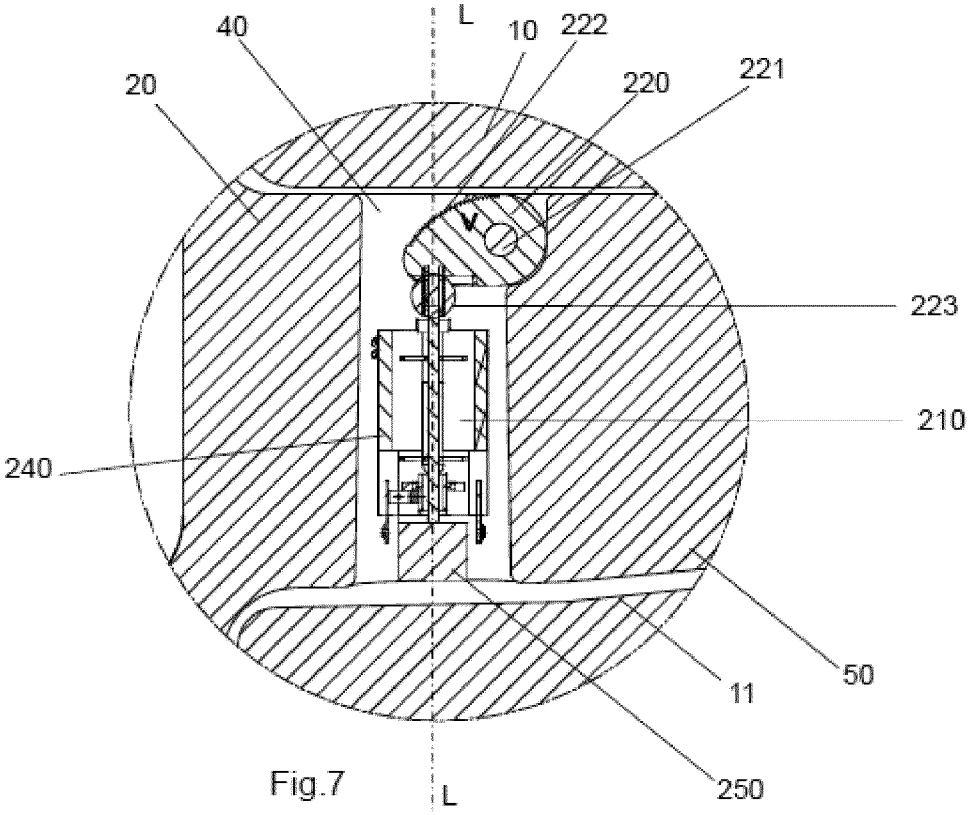
FIG. 7 shows a detailed cross section of FIG. 5 wherein the location of the fastening device in accordance with the second embodiment in the housing of the second part can be seen.
Figure 8:
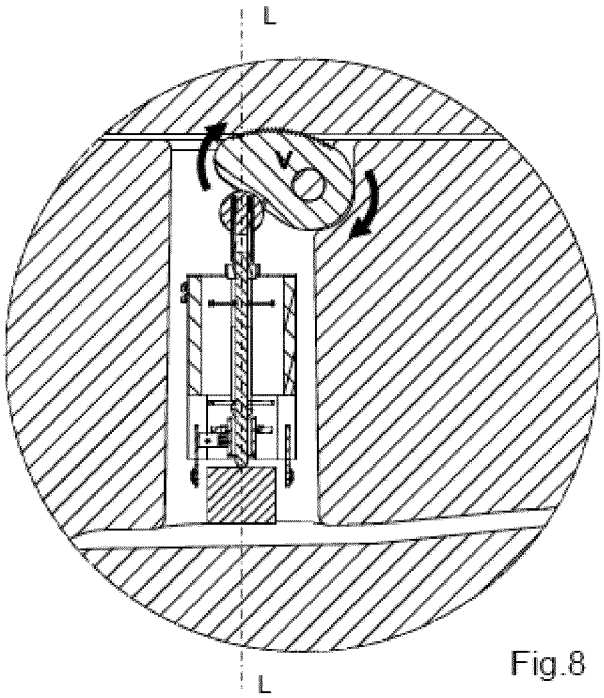
FIG. 8 shows another detailed cross section of FIG. 5 wherein the location of a displaced fastening device in accordance with the second embodiment in the housing of the second part can be seen.
Figure 9:
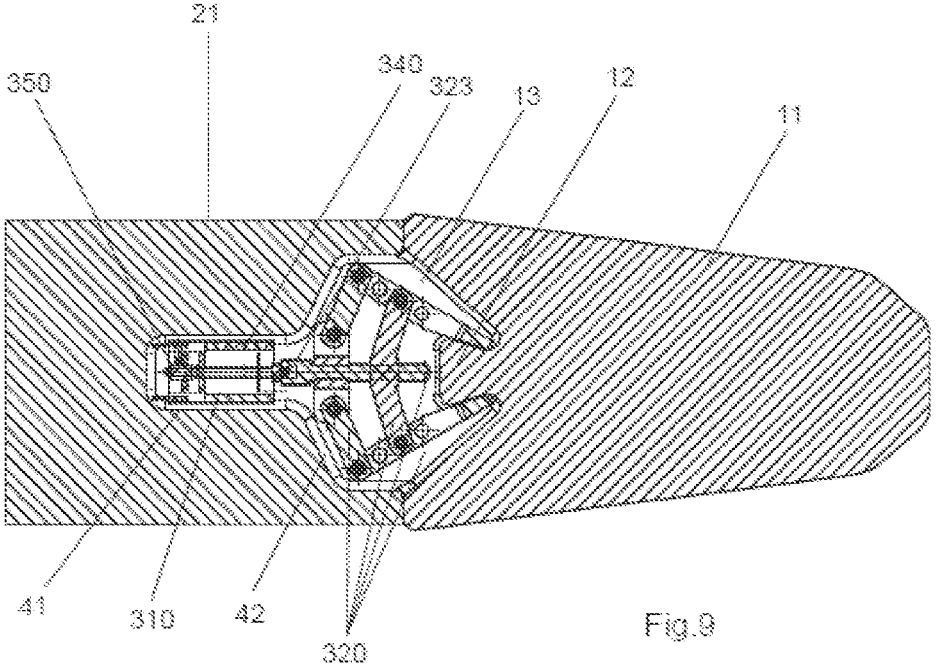
FIG. 9 shows a cross section of a retention system between two parts, a first wear part or tooth and a second wear part, which can be a tooth-holder or an intermediate part or element, where this second part comprises a housing to insert the fastening device and the wear part or tooth comprises a projection on which the fastening device is secured in accordance with a third embodiment according to the invention.
Figure 10:
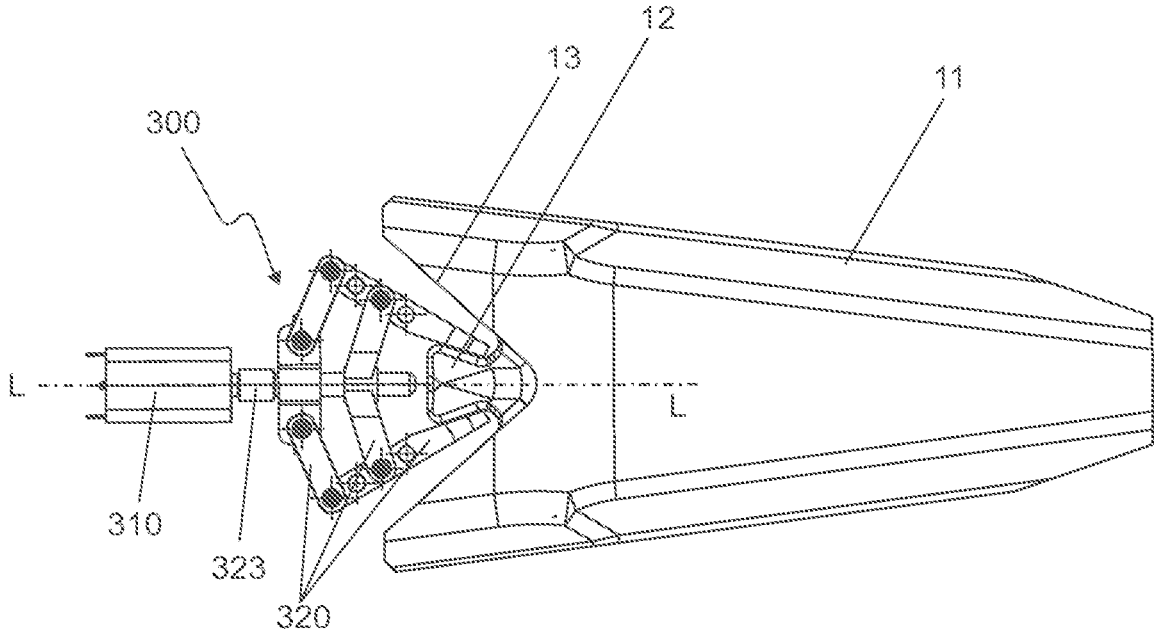
FIG. 10 shows another view, without the second part, wherein the tooth and the projection thereof can be seen next to the fastening device in accordance with the third embodiment.
Figure 11:
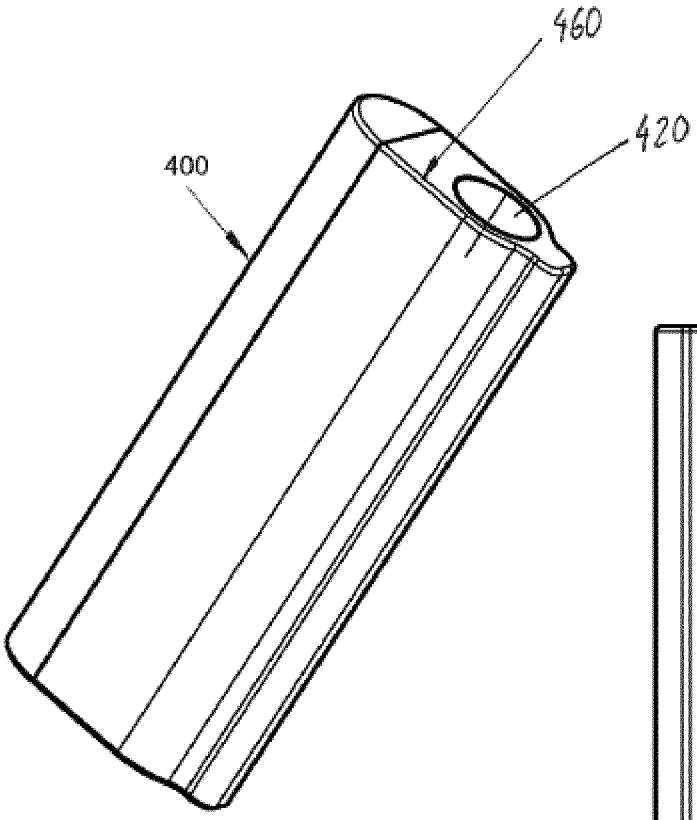
FIG. 11 shows a perspective view of a fourth embodiment of a fastening device according to the invention, comprising two mobile blocking elements moving in opposite directions on both sides of a longitudinal axis of the device.
Figure 12:
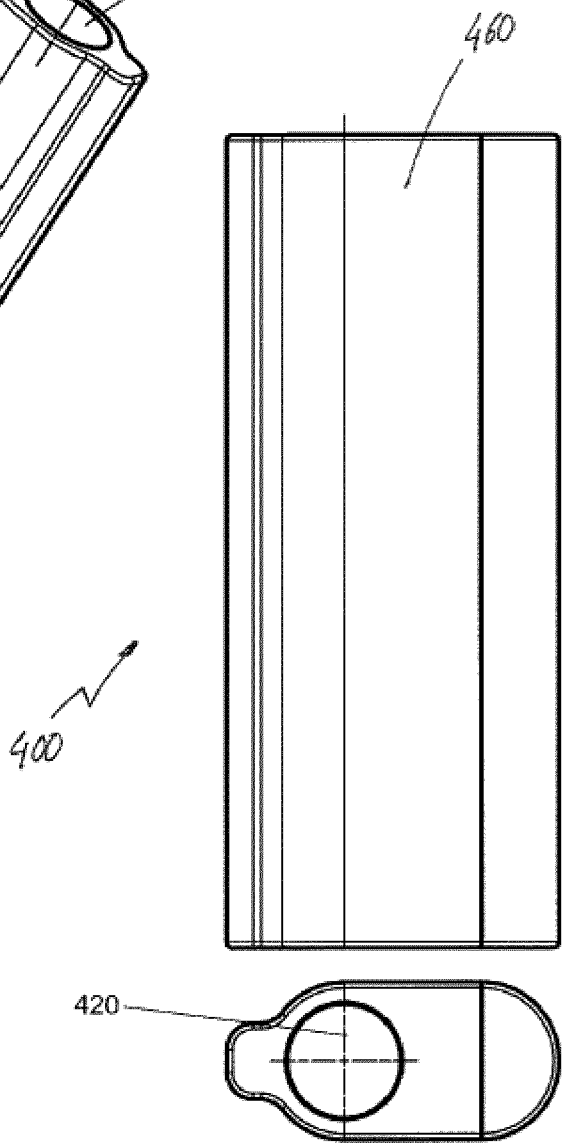
FIG. 12 shows a side view and an upper/lower view of the embodiment in FIG. 10.
Figure 13:
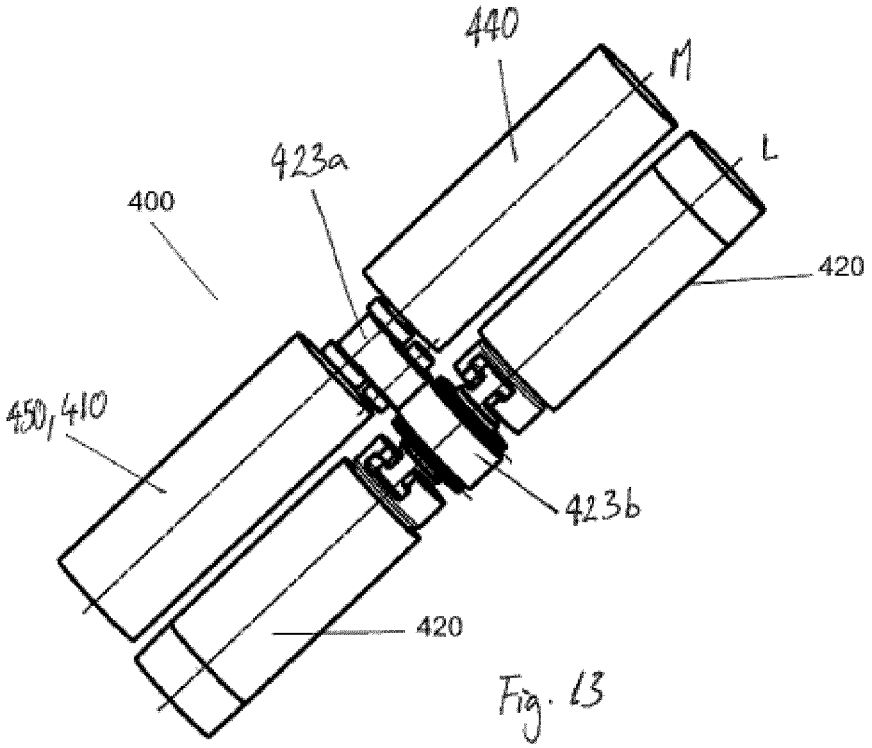
FIG. 13 shows the components of the fastening device according to FIGS. 11 and 12 without the case that holds, keeps and protects said elements within the case.
Figure 14:
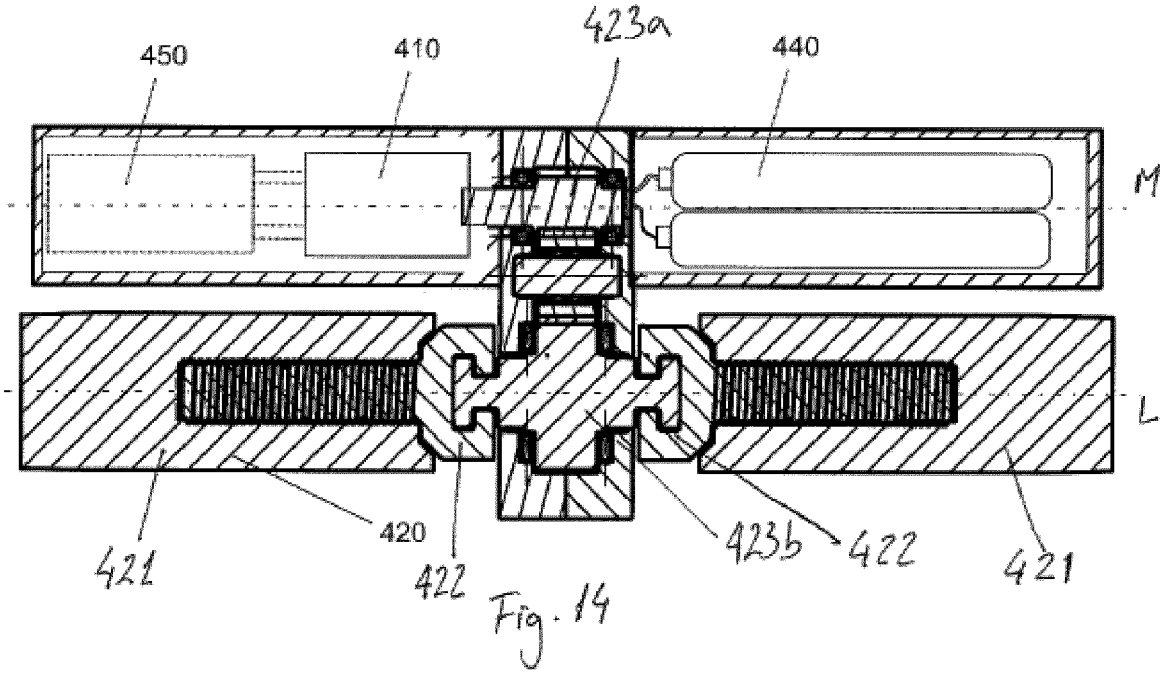
FIG. 14 shows a cross section of the components of FIG. 13.

In order to maintain the position of the fastening device 100 in the working position thereof in the channel 4 of the tooth-holder 2, as shown in FIG. 4, the fastening device 100 is inserted in a hollow cylindrical case, cover or body 160 made of a resistant material, which is subsequently inserted in the channel 4 of the tooth-holder. Externally, the case 160 is the shape of the opening of the channel 4 of the tooth-holder in order to prevent, if it is cylindrical, said case 160 from rotating in the inside of the channel 4, that is, the outer cross section of the case 160 is largely the same as the cross section of the channel 4 of the tooth-holder, such that it enables the insertion thereof in said channel 4 but does not enable the rotation thereof inside the same. The case 160 likewise comprises an inlet hole in one of the bases thereof through which the fastening device 100 is inserted and can also have a rear hole in the opposite base that has a housing, of the through type or not, for the insertion of the end of the fastening device 100 opposite that of the mobile blocking device 120. In this way, the mobile element 120 can come out through the inlet hole of the case 160. Said case 160 further comprises at least one through hole in the surface thereof for the insertion of a tightening element or screw 161 that is inserted in a groove 121 made in the surface of the mobile blocking element 120 once the device 100 is inserted in the case 160. After the insertion of the fastening device in the case 160, the screw 161 is adjusted so that it is inserted in the groove 121 of the mobile element 120. In this way, it is ensured that the mobile element 120 does not rotate inside the case 160 and the path of the mobile blocking element 120 is controlled. Likewise, in order to prevent the motor 110 from rotating about its own axis (L), it must be secured inside the case 160, for which reason the inner cross section of the case 160 at the end or place where the motor 110 is located once inserted in the case 160, must preferably be complementary to the outer cross section of the motor 110 or alternatively have an element that secures the motor 110 inside the case 160, thus preventing it from rotating about its axis L. In this example, the inside of the case has at least one flat surface that comes into contact with the flat surface of the batteries 140 that are located externally to the motor 110, such that the contact between both flat surfaces prevents the rotation of the motor 110 about its axis. After inserting and ensuring the position of the fastening device 100 in the case 160, the same is inserted in the channel 4 of the nose of the tooth-holder 2, to subsequently couple the tooth 1 in said nose 2 and aligning the channel 4 with the hole 3 of the tooth. The foregoing is seen in stage A of FIG. 4.

Once arranged in the channel 4 of the tooth-holder 2, and as can be seen in stage B of FIG. 4, the mobile element 120 of the fastening device 100 is activated in accordance with some of the options already described above, such that the motor 110 causes the rotation of the transmission elements 123 that are coupled to the shaft 122, which is in turn threaded inside the mobile element 120. In this way, when the inner shaft 122 rotates, it causes the rotation of the mobile element 120 that, due to having limited rotation as a result of the action of the screw 161, moves along the longitudinal axis L of the fastening device in the direction of the horizontal arrow H. In this translation movement, the screw 161 remains inside the groove 121 of the mobile element 120. This movement of the mobile element 120 causes it to be inserted in the hole 3 of the tooth 1 and come into contact with the walls of said hole 3, ensuring the retention between the tooth 1 and the tooth-holder 2.

In stage C of FIG. 4, uncoupling takes place when the tooth 1 has moved according to the vertical arrow "P" due to brinelling (wear due to contact) and plastic deformation due to large impacts caused between the tooth 1 and tooth-holder 2 as a result of the work of the system or assembly. This brinelling causes the system to no longer be tight given that the mobile element 120 is no longer in contact with the walls of the hole 3 of the tooth 1. In this way, it is difficult for the tooth to uncouple from the tooth-holder 2, but there is movement between both parts, tooth 1 and tooth-holder 2, which increases said brinelling and also increases the relative movement between the two parts.

In order to resolve this problem of lack of tightness between the tooth 1 and the tooth-holder 2 and by extension with the fastening device 100, the mobile blocking element 120 is autonomously or automatically (although it can also be remotely) activated in accordance with the instructions received from the activation means 150 and according to any of the activation options described above. By means of the new longitudinal movement in accordance with the horizontal arrow "H" of the mobile blocking element 120, it comes back into contact with the walls of the hole 3 of the tooth 1, the coupling between the tooth 1 and the tooth-holder 2, and therefore the whole system, thus being re-tightened. This can be seen in stage D of FIG. 4.

In a second exemplary embodiment, the fastening device 200 is inserted in a housing made in the nose of a second adapter element 20, in this case shown represented by an intermediate element, which at one end is coupled to a wear element or tooth 10 and at the opposite end is coupled to a nose (not shown), or another part, through holes 30 made in the wall of the intermediate element 20. Said intermediate element could also be a tooth-holder or the nose in a blade of a bucket. Likewise, the intermediate element 20 has two noses 50, each one being independent, with a housing 40 and that are inserted in cavities 16, which are also independent, arranged in the tooth 10 and separated by a wall 17. Before the coupling of the tooth 10, the fastening devices 200 are inserted in said housing 40. Clearly, this second part 20 could be a conventional tooth-holder instead of an intermediate element, or even the blade of a bucket of an earth-moving machine.

In this example, the two fastening devices 200 have the same components, although as they are arranged at opposite ends, the arrangement of the components in one device and the other is symmetrical. Said devices 200 comprise a longitudinal axis L, a mobile blocking element 220, located at one end of the fastening device 200 and connected to the actuation means 210 by means of mechanical transmission means 223. Said transmission means 223 can also be hydraulic, pneumatic, magnetic or a combination of any of the above.

Similarly to the example above, the actuation means 210 is an electric motor, although it could be a hydraulic or pneumatic motor or electromagnetic elements that enable the mechanical transmission means 223 to be actuated in order to move the mobile blocking element 220. The device 200 has power supply means 240, preferably a battery, which is responsible for supplying electricity to the actuation means 210 as well as the receiver device 250 or activation means. The mobile element 220 has a body with an upper surface, a lower surface and a continuous side wall or several side walls, and acts as a cam, having the join with the transmission means 223 in the wall of one end and a rotary projection or pin 221 in the upper surface of the other end with respect to the vertical axis V with respect to which it rotates. The longitudinal axis L and the vertical axis V are on planes that are perpendicular to each other, although said axes do not intersect. Preferably, the mobile element 220 is the shape of a right-angled triangle with a curved hypotenuse and rounded corners such that in the portion thereof with the acute angle it connects to the transmission means 223 and in the portion thereof with the right angle it has the rotary projection 221. Likewise, in the curved side wall and opposite that of the connection with the transmission means 223, the body of the mobile element 220 has a retention surface, that is rough or has projections since it is the surface that comes into contact with the wear element 10 when the fastening device 200 is activated.

In this embodiment, after the coupling of the fastening device 200 in the housing 40 of the intermediate element 20, the fastening device 200 is located such that the end with the mobile blocking element 220 is located in the inner portion of the intermediate element 20, both mobile elements 220 in this specific example facing and close to each other, separated by a space in which an intermediate wall 17 is inserted that separates the two cavities 16 of the tooth 10. Each of these housings 40 has, at the end where the mobile element 220 is fitted, a particular configuration since it must house the rotary projection or pin 221 with respect to which the mobile element 220 subsequently rotates.

Once the parts and the fastening device 200 are coupled, the mobile blocking element is remotely activated by means of actuating the activation means 250. For example, by sending a signal to a receiver of the activation means 250 of the fastening device 200. This signal causes the actuation means 210 to activate the mechanical transmission means 223 which move longitudinally along the longitudinal axis L of the fastening device 200, causing the rotation of the mobile element 220 with respect to the rotary projection 221 and, therefore, the vertical rotation axis V. This movement causes the mobile blocking element 220 to move outside the cavity 40, as well as the curved and rough surface 222 to engage and interact with the surface of the intermediate wall 17 of the tooth 10 located between both cavities 16, or with one cavity or recess made in the surface of said wall 17. In this way, the position of the fastening device 200 between a first wear part 10 and a second part 20 is ensured.

The activation means 250 autonomously enable, similarly to the first example, the tightness between the different components to be maintained by means of the periodic activation of the mobile blocking element depending on the different constraints that are previously predefined.

In order to achieve the separation of the tooth 10 from the nose 20, the mobile blocking element 220 must return to its initial position, such that there is no engagement between said mobile element 220, the tooth 10 and the nose 20. To do so, the activation means 250 cause the mobile blocking element or cam 220 to move again to its initial unblocking position.

In a third exemplary embodiment, the retention system is formed by a wear part or tooth 11 with a cavity 13 and a projection or lug 12 in said housing 11. Likewise, the second part or adapter 21 further comprises a cavity 42 with a housing 41. The fastening device 300 is inserted in said housing 41.

Said fastening device 300 comprises the actuation means 310 of the mobile blocking element of the fastening device 300 in the end that is inserted in the housing 41 of the adapter 21. Next to said actuation means, which are preferably an electric motor, although it can also be a hydraulic or pneumatic motor or electromagnetic elements, there is a receiver 350, or activation means, which is responsible for activating the actuation means 310 and power supply means or battery 340, which are responsible for supplying electricity to the components that require it. Said actuation means 310 are connected to at least one mobile blocking element 320 through transmission means 323. In this example, the mobile blocking element 320 comprises an assembly of articulated elements that are connected to a bushing that moves along a shaft connected to the transmission means 323. In this way, the rotation of the shaft causes the movement of the bushing connected to said articulated elements which, depending on the direction of movement of said bushing, cause the articulated elements to separate or move closer together. Said transmission means 323 can also be hydraulic, pneumatic, magnetic or a combination of any of the above.

To mount the fastening device 300 in the system, the end of the device 300 that is opposite to the mobile element 320 is inserted in the housing 41 of the tooth-holder 21, the mobile element 320 being housed in the cavity 42 of said tooth-holder 21. Subsequently, the tooth 11 is placed on the tooth-holder 21 and the actuation means 310 of the device 300 are remotely activated, and which cause the longitudinal movement of the bushing of the mobile element 320 along the longitudinal axis L of the device 300. This longitudinal movement of the bushing causes the articulated elements of the mobile device to move closer and "grip" or exert pressure on the projection or lug 12 of the tooth 11, thus ensuring the coupling and retention between the tooth and the tooth-holder.

FIGS. 11 to 14 show a fourth embodiment of a fastening device 400 for coupling a first part or tooth and a second part, adapter or tooth holder. Said fastening device 400 is inserted in a channel, preferably in the nose of the adapter, and subsequently the tooth is coupled on the adapter, as in the first embodiment explained.

The fastening device 400 comprises a body with two longitudinal axis, a first longitudinal axis L and a second longitudinal axis M and two mobile blocking elements 420 that are activated from the activation means 450 and move along the first longitudinal axis L. The blocking elements 420 are located on opposite ends of the fastening device 400, and by means of the longitudinal movement of these mobile elements 420 along the first axis L, the fastening of the coupling between the tooth and the tooth-holder is achieved when it engages with the two parts. In order to achieve the movement of the mobiles elements 420, the fastening device 400 comprises:

- a motor 410 as actuator means with first transmission means 423*a* for reducing the speed of the motor 410,
- second transmission means 423*b*, connected to the first transmission means 423*a*, and placed approximately in the middle of the fastening device 400,
- two mobile blocking elements 420, each with a bolt 421 connected to a screwed shaft 422, placed on opposite sides of the second transmission means 423*b*, that when said transmission means 423 are activated the blocking elements 420 move parallel to the longitudinal axis L because the screwed shaft 422 turns displacing the bolt 421,
- a power supply or battery 440, and
- autonomous activation means 450 comprising the microprocessor or processor, as well as other electronic components required, preferably placed in an electronic board, and that can be connected to other electronic components such as an emitter and/or receiver 450' that can be placed separated from the electronic board.

The transmission means are important when the actuation means or motor 410 does not have the required power because the space inside the case 460 of the fastening device 400 limits the size of the activation means or motor 410, and therefore the power of the same, introduced in said case 460 of the device 400. Due to this limitation in space, and to be able to move the blocking elements 420, or element, with a small exit torque from the motor 410, the transmission means 423 comprise gears 423*a*, 423*b*. These are placed for reducing the speed that exits the shaft of the motor 410 and increasing the torque, therefore allowing the displacement of the blocking elements 420 along the longitudinal axis L. Depending of the size of the fastening device and the space available inside said fastening device, the number of transmission means or gears forming part of said transmission means can be modified and therefore have one, two, three or more gears/reducers in the transmission means 423.

The transmission means are preferably two gears 423*a*, 423*b* working as speed reducers that serve to increase the torque exiting from the actuation means to a torque capable of moving the blocking element or elements 420. Therefore, as stated, the number of gears or reducers 423*a*, 423*b* to be placed between the exit of the actuation means 410 and the blocking element or elements 420 will depend on the space, torque exiting from the actuation element 410 and torque required to move the blocking element or elements 420. For example, as shown in the fourth embodiment, a first reducer 423*a* can be placed at the exit shaft of the actuation element 410 and a second reducer 423*b* can between said first reducer 423*a* and the blocking element 420 or elements to transmit the torque to this/these. As an example, for a torque exiting the motor 410 of about 0.5 Nm, the torque moving the blocking elements 420 at the exit of the second transmission means or gears 423*b* is around 135 Nm.

Due to space restrictions, the previous elements have a particular distribution in the fastening device 400. Specifically, the elements are placed along the two parallel longitudinal axis, L, M, such that the two blocking elements 420 along the first longitudinal axis are parallel to the power supply, battery, 440 and the actuation means, motor, 410 placed along the second longitudinal axis M. Further, both blocking elements 420 are separated by the second transmission means 423*b*, as well as the battery 440 and the motor 410 with the first transmission means 423*a*. The autonomous activation means 450 are preferably placed between the battery 440 and one of the mobile blocking elements 420 and the emitter/receptor can be placed closed to one end of the battery 440.

As in previous embodiments, the transmission means 423 are preferably mechanical, gears, but they can also be hydraulic, pneumatic, magnetic or a combination of any of the above.

The operation of this embodiment 400 is similar to the one of the first embodiments, such that when the fastening device 400 is in place in the tooth-holder coupled in the housing of the tooth, a signal is generated by means of which the activation means 450 activates the motor 410 that is powered by the battery 440, and through the gear transmissions 423, the moving blocking elements 420 are longitudinally moved in opposite directions along the axis L. Other additional features of this fourth embodiment of a fastening device 400 are similar to the features described for the fastening device of the first embodiment 100.

The fastening devices 100, 200, 300, 400, as well as the systems in which they are installed, can incorporate the following element in addition to those mentioned above:

- The receiver installed in the actuation means of the device itself can also act as an emitter element for information exchange between the fastening device and the exterior,
- Sensors the enable the measurement of variables inside the housings, such as for example temperature, or incorporating sensors that enable the measurement of stresses to which the device is subjected, and
- Positioning devices of the fastening device, such as for example a GPS device.

The invention claimed is:

1. A fastening device of a first part or wear part in a second part in earth-moving machines comprising at least one mobile blocking element and autonomous activation means of said mobile blocking element, said activation means comprising at least one processor configured to control movement of the mobile blocking element to a first position wherein the mobile blocking element engages between the first part and the second part, thereby blocking movement of the first part relative to the second part and to control movement of the mobile element to a second position wherein the mobile blocking element disengages between the first part and the second part, thereby unblocking movement of the first part relative to the second part; wherein said activation means is configured to control movement of the mobile blocking element autonomously.

2. The device, according to claim 1, further comprising:

actuation means of the mobile blocking element connected to the activation means, transmission means located between the actuation means and the mobile blocking element, and a power supply of the actuation means of the mobile blocking element.

3. The device, according to claim 1, wherein the processor is connected to an emitter/receiver device to remotely control the device.

4. The device, according to claim 1, wherein the processor is connected to different sensors arranged in the device or to components external to the device.

5. The device, according to claim 2, wherein the actuation means comprise an electric, hydraulic or pneumatic motor.

6. The device, according to claim 2, wherein the actuation means comprise electromagnetic elements that generate at least one electromagnetic field that acts on the blocking element.

7. The device, according to claim 1, wherein the transmission means comprise mechanical and/or hydraulic and/or pneumatic and/or magnetic means.

8. The device according to claim 1, wherein the device comprises at least one longitudinal axis (L) with respect to which the at least one mobile blocking element moves.

9. The device according to claim 8, wherein the at least one blocking element moves longitudinally with respect to the longitudinal axis (L).

10. The device according to claim 8, wherein the blocking element rotates with respect to the longitudinal axis (L).

11. The device, according to claim 1, wherein the autonomous activation means activate the mobile blocking element at a predetermined periodicity.

12. A retention system between a first wear part and a second part in earth-moving machines comprising a device according to claim 1.

13. The system, according to claim 12, wherein the device is arranged in a housing in the second part and engages with a hole or cavity or surface arranged on the wear part wherein the mobile blocking element engages with the second part by means of the insertion thereof in the hole or cavity or by means of friction or pressure against the surface.

14. The device, according to claim 2, wherein the transmission means is coupled to a shaft that has a threaded coupling to the mobile blocking element and rotation of the shaft causes the rotation of the mobile blocking element which is fixed against rotation, thereby moving the mobile blocking element in translation in a direction of movement between the first position and the second position.

15. The device, according to claim 1, wherein the at least one processor incorporates operation instructions that are autonomously executed by the at least one processor to move the mobile blocking element in a direction of movement between the first position and the second position.

16. The device, according to claim 15, wherein the at least one processor incorporates operation instructions that are autonomously executed by the at least one processor to periodically move the mobile blocking element in the direction of movement according to a predetermined periodicity.

17. The device, according to claim 15, wherein the at least one processor incorporates operation instructions that are autonomously executed by the at least one processor, based on a signal from a sensor indicative of wear, to move the mobile blocking element in the direction of movement.

18. The device, according to claim 1, wherein mobile blocking element comprises:

a cavity having an internal thread about a longitudinal direction of the mobile blocking element extending in the direction of travel of the mobile blocking element, and an inner shaft having an external thread coupled to the internal thread;

wherein rotation of the inner shaft in one direction causes a distal end of the mobile blocking element to move toward the first position and rotation of the inner shaft in an opposite direction causes a distal end of the mobile blocking element to move toward the second position.

19. The device, according to claim 1, further comprising a casing in a form of a sleeve around at least a portion of the mobile blocking element, the casing and the mobile blocking element mechanical coupled to one another by a longitudinal groove and guide element extending within the longitudinal groove to allow relative sliding movement along a direction of movement of the mobile blocking while fixing the mobile blocking element and the casing against relative rotation during relative sliding movement of the casing and the mobile guide element.

20. The device, according to claim 1, wherein the processor is connected to a sensor arranged in the device or to components external to the device and configured to detect a state of wear between the first part and the second part.

* * * * *